US010847889B2

(12) United States Patent
Oladeinde et al.

(10) Patent No.: US 10,847,889 B2
(45) Date of Patent: Nov. 24, 2020

(54) PATCH ANTENNA WITH ISOLATED FEEDS

(71) Applicant: Intel Corporation, Santa Clara, CA (US)

(72) Inventors: Adewale K Oladeinde, Hillsboro, OR (US); Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 56 days.

(21) Appl. No.: 16/305,716

(22) PCT Filed: Jun. 30, 2016

(86) PCT No.: PCT/US2016/040462

§ 371 (c)(1),
(2) Date: Nov. 29, 2018

(87) PCT Pub. No.: WO2018/004611

PCT Pub. Date: Jan. 4, 2018

(65) Prior Publication Data

US 2019/0207314 A1 Jul. 4, 2019

(51) Int. Cl.
*H01Q 9/04* (2006.01)
*H01Q 25/00* (2006.01)
(Continued)

(52) U.S. Cl.
CPC ..... *H01Q 9/045* (2013.01); *H01Q 1/521* (2013.01); *H01Q 9/0407* (2013.01);
(Continued)

(58) Field of Classification Search
CPC .... H01Q 9/045; H01Q 25/001; H01Q 9/0407; H01Q 1/521; H01Q 21/0025;
(Continued)

(56) References Cited

U.S. PATENT DOCUMENTS

2004/0239567 A1 12/2004 Van Der Poel
2005/0110685 A1* 5/2005 Frederik du Toit ..... H01Q 9/0414 343/700 MS (Continued)

FOREIGN PATENT DOCUMENTS

CN 103474756 A * 12/2013
TW 201803201 A 1/2018
WO WO-2018004611 A1 1/2018

OTHER PUBLICATIONS

Y. Cheng and Z. Wang, Reduce Size Dual-polarized Microstrip Antenna, Springer International Publishing Switzerland, 2014, pp. 549-553 (Year: 2013).*

(Continued)

*Primary Examiner* — Dieu Hien T Duong
(74) *Attorney, Agent, or Firm* — Schwegman Lundberg & Woessner, P.A.

(57) ABSTRACT

Methods and devices disclosed herein relate to a patch antenna. The patch antenna can include a patch having a conductive sheet including at least one edge. The patch can include a first polarization direction and a second polarization direction. A first antenna feed can be coupled to the patch. The first antenna feed can be positioned to transmit or receive a first signal along the first polarization direction. A second antenna feed can be coupled to the patch. The second antenna feed can be positioned to transmit or receive a second signal along the second polarization direction. At least one antenna aperture can be isolated from an edge of the patch and disposed along an aperture path. An orientation of the aperture path can bisect the first polarization direction and the second polarization direction. In one example, the antenna aperture can be located between the first antenna feed and the second antenna feed.

24 Claims, 6 Drawing Sheets

(51) Int. Cl.

| | |
|---|---|
| ***H01Q 1/52*** | (2006.01) |
| ***H01Q 21/00*** | (2006.01) |
| ***H01Q 21/06*** | (2006.01) |
| ***H01Q 21/22*** | (2006.01) |
| ***H01Q 21/24*** | (2006.01) |
| *H01Q 5/378* | (2015.01) |

(52) U.S. Cl.
CPC ..... *H01Q 21/0025* (2013.01); *H01Q 21/065* (2013.01); *H01Q 21/22* (2013.01); *H01Q 21/24* (2013.01); *H01Q 25/001* (2013.01); *H01Q 5/378* (2015.01); *H01Q 9/0435* (2013.01)

(58) Field of Classification Search
CPC ..... H01Q 21/065; H01Q 21/22; H01Q 21/24; H01Q 9/0435; H01Q 5/378; H01Q 9/0414; H01Q 1/2283
See application file for complete search history.

(56) References Cited

U.S. PATENT DOCUMENTS

| | | | | |
|---|---|---|---|---|
| 2008/0204326 | A1 | 8/2008 | Zeinolabedin Rafi et al. | |
| 2009/0256773 | A1 | 10/2009 | Lindmark | |
| 2011/0012788 | A1* | 1/2011 | Rowell | H01Q 9/0414 343/700 MS |
| 2011/0025571 | A1* | 2/2011 | Adada | H01Q 1/38 343/770 |
| 2014/0145883 | A1 | 5/2014 | Baks et al. | |
| 2014/0145884 | A1 | 5/2014 | Dang et al. | |
| 2014/0203968 | A1 | 7/2014 | Hsu et al. | |
| 2016/0126633 | A1 | 5/2016 | Keller et al. | |

OTHER PUBLICATIONS

"International Application Serial No. PCT/US2016/040462, International Search Report dated Mar. 28, 2017", 3 pgs.
"International Application Serial No. PCT/US2016/040462, Written Opinion dated Mar. 28, 2017", 8 pgs.
"European Application Serial No. 16907565.2, Extended European Search Report dated Jan. 27, 2020", 10 pgs.
Cheng, Yong, "Reduce-Size Dual-Polarized Microstrip Antenna", In: Mechatronics and Automatic Control Systems, (Oct. 4, 2013), 549-554.
Zaman, A UZ, "Dual polarised microstrip patch antenna with high port isolation", Electronics Letters, IEE Stevenage, GB, vol. 43, No. 10, (May 10, 2007).

* cited by examiner

PATCH ANTENNA WITH ISOLATED FEEDS

CROSS-REFERENCE TO RELATED APPLICATION

This application is a U.S. National Stage Filing under 35 U.S.C. 371 from International Application No. PCT/US2016/040462, filed on Jun. 30, 2016, which application is incorporated herein by reference in its entirety.

TECHNICAL FIELD

This document pertains generally, but not by way of limitation, to antennas, such as microstrip antennas.

BACKGROUND

Existing antennas, such as microstrip antennas can be used for transmitting or receiving radio wave signals. For example, microstrip antennas can be used for wireless and mobile communications, for instance, the microstrip antenna can be used in devices having 3G, 4G/LTE, or Wi-Fi capability. Some microstrip antennas include a flat metallic plate arranged over a ground plane. In existing examples, a signal source can be connected to the metallic plate of the microstrip antenna by an antenna lead. Microstrip antennas can be tuned to transmit or receive a signal at a particular wavelength. For instance, the dimensions, shape, or substrate material selection of the microstrip antenna can be configured to transmit or receive a signal at a particular wavelength.

Some existing examples of microstrip antennas include dual polarized microstrip antennas. For instance, two antenna leads can be connected to the radiating element of the microstrip antenna. Each antenna lead can transmit or receive along a different direction of the microstrip antenna. For instance, a signal from a first antenna lead can propagate across a signal path of a second signal propagating from a second antenna lead. Accordingly, in some examples, isolation between the two antenna leads can be reduced as a result of both leads being located on the same metallic plate.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
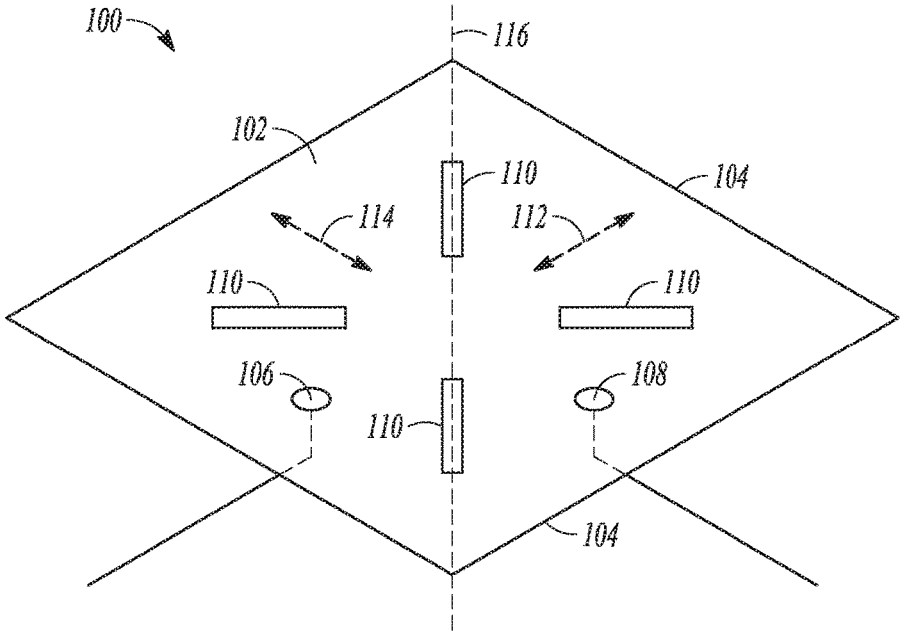
FIG. 1 is a perspective view of a patch antenna including a plurality of antenna apertures, according to an embodiment.

The present application relates to devices and techniques for a patch antenna, such as a patch antenna including at least one antenna aperture adapted to increase the isolation between two or more antenna feeds coupled to the patch antenna. The following detailed description and examples are illustrative of the subject matter disclosed herein; however, the subject matter disclosed is not limited to the following description and examples provided. Portions and features of some embodiments may be included in, or substituted for, those of other embodiments. Embodiments set forth in the claims encompass all available equivalents of those claims.

The present inventors have recognized, among other things, that providing two or more antenna feeds and a single patch for using the patch as a dual polarized patch antenna can generate interference between the signals transmitted or received by the two or more antenna feeds. The present subject matter can provide a solution to this problem, for instance by including at least one antenna aperture isolated from an edge of the patch and disposed along an aperture path bisecting a first polarization direction and a second polarization direction of the patch. In one example, the antenna aperture can be located between a first antenna feed and a second antenna feed. Accordingly, the impedance between the two or more antenna feeds can be increased, and as a result isolation between the two or more antenna feeds can be correspondingly increased.

The number, size, or position of the antenna apertures can be configured in various arrangements including, but not limited to, those described herein. In one example, the patch can include a plurality of antenna apertures disposed along the aperture path. For instance, a plurality of antenna apertures can be disposed from a first side of the patch to a second side of the patch. In some examples, the patch can include a rectangular shape. Each antenna feed can be offset from the center of an edge of the patch and each antenna feed can be offset from an edge that is adjacent to an edge of another antenna feed. The one or more antenna apertures can be positioned along a diagonal of the rectangular patch. In one or more examples, at least one antenna aperture can be located in each quadrant of the patch, for instance, along the diagonal of a rectangular patch. In some examples, a plurality of antenna apertures can be arranged in a meshed pattern (e.g., a grid or lattice structure of antenna apertures). In one or more examples, an electronic package can include the patch antenna having at least one antenna aperture as previously described. At least one secondary patch (e.g., parasitic patch) can be included in the electronic package. Secondary antenna apertures can be located along the secondary patch, for instance, the secondary antenna apertures can be similarly positioned on the secondary patch to the antenna apertures located on the patch. Accordingly, the one or more antenna apertures on the patch can increase the impedance and thus the isolation between the two or more antenna feeds. The increased isolation between the two or more antenna feeds can increase the gain of the patch antenna (e.g., increase the directionality of the antenna) without reducing the signal bandwidth that can be transmitted or received by the patch antenna.

FIG. 1 illustrates a perspective view of an exemplary patch antenna 100. The patch antenna 100 can include a patch 102. The patch 102 can be a main radiating element. In an example, the patch 102 can be a conductive sheet having at least one edge 104. A first antenna feed 106 and a second antenna feed 108 can be coupled to the patch 102. For instance, the first antenna feed 106 and the second antenna feed 108 can be electrically coupled to the patch 102. Accordingly, the patch antenna 100 can transmit signals communicated through the first antenna feed 106 or the second antenna feed 108. In an example, the patch antenna 100 can receive signals radiated from other sources and communicate the received signals to a die or transceiver. The patch 102 can include at least one antenna aperture 110. The aperture 110 can be located between the first antenna feed 106 and the second antenna feed 108 as described further herein.

The patch 102 can include a conductive sheet constructed from a material including, but not limited to, electrodeposited copper, sputtered copper deposition, rolled and annealed copper, leaded solder (tin/lead), lead free solder (tin/copper), Electroless Nickel Immersion Gold (ENIG), soft gold, hard gold, immersion silver, immersion gold, immersion tin, conductive ink, or the like. In an example, the patch can be covered with an organic surface protectant to reduce oxidation. Other materials including glass, ceramic and their derivatives may also be used to protect the conductive sheet. In an example, the conductive layer can include a Copper Clad Laminate (CCL). The patch 102 can include a total thickness including, but not limited to, 1.0-250.0 microns. Accordingly, the patch 102 can be conductive to electromagnetic signals to facilitate the transmission or reception of radio waves.

In one or more examples, the patch 102 can be a shape including, but not limited to, a square, rectangle, circle, oval, triangle, polygon, or other shape adapted to radiate signals along one or more polarization directions of the patch 102. Depending upon the shape, the patch 102 can include one or more edges 104. At least one of the edges can radiate a radio wave corresponding to the signal communicated by the first antenna feed 106 or the second antenna feed 108. In the example of FIG. 1 the patch 102 can include a rectangular shape having four edges 104. The four edges 104 and the conductive sheet of the patch 102 can receive or transmitting signals.

The dimensions of the patch 102 can be configured to resonate at a particular wavelength (e.g., frequency). In one or more examples, the patch 102 can include one or more polarization directions. In other words, the size and shape of the patch 102 can be configured to resonate at a particular frequency along one or more directions of the patch 102. For instance, in the example of FIG. 1, the length of the patch 102 can be about one-quarter of the particular wavelength of the transmitted or received signal. The width of the patch 102 can be shorter than the length of the patch 102 and therefore be tuned to a correspondingly smaller wavelength signal (e.g., higher frequency). Accordingly, the patch 102 can be tuned to transmit or receive signals at one or more particular frequencies along a corresponding number of polarization directions. For instance, the length of the patch can correspond to a vertical polarization direction (e.g., a first polarization direction 112) and the width of the patch 102 can correspond to a horizontal polarization direction (e.g., a second polarization direction 114). In one example, the patch 102 can be sized and shaped to include three or more polarization direction, such as a hexagonal patch, octagonal patch, or the like. The dimensions of the patch 102 can be tuned to transmit or receive signals in the 500 MHz to 100 GHz range, for instance, 24 GHz, 28 GHz, 39 GHz, 60 GHz, 73 GHz, or other frequency. In the example of the patch 102 tuned to 30 GHz, the patch 102 can include a width of 2.54 mm and a length of 2.54 mm.

Figure 2:
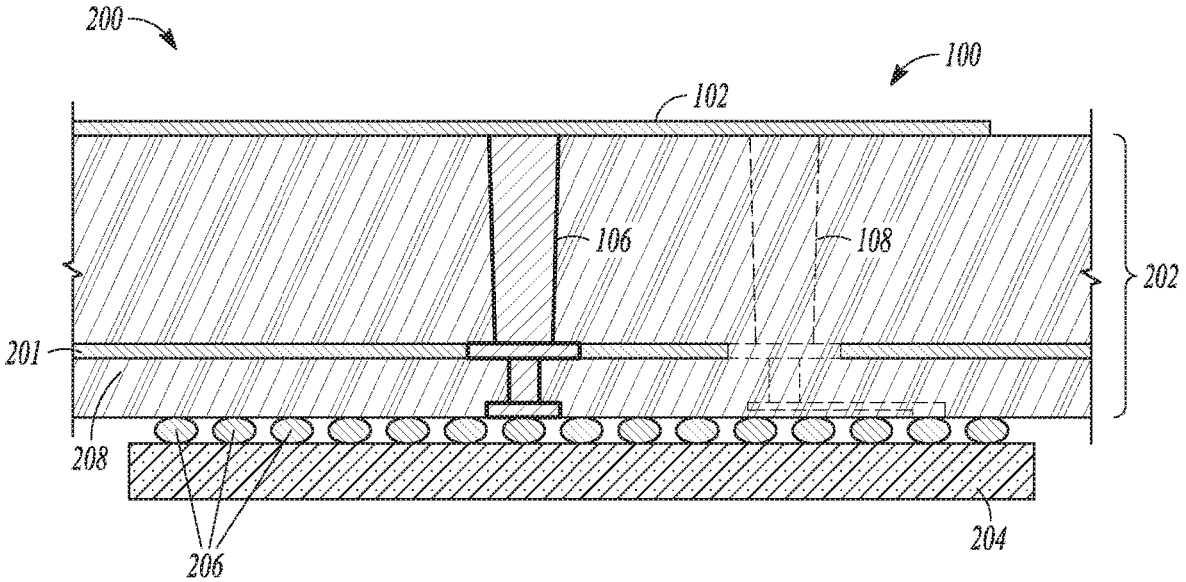
FIG. 2 depicts an exemplary cross section of an electronic package including a patch antenna, a substrate, and a die, according to an embodiment.
Figure 6:
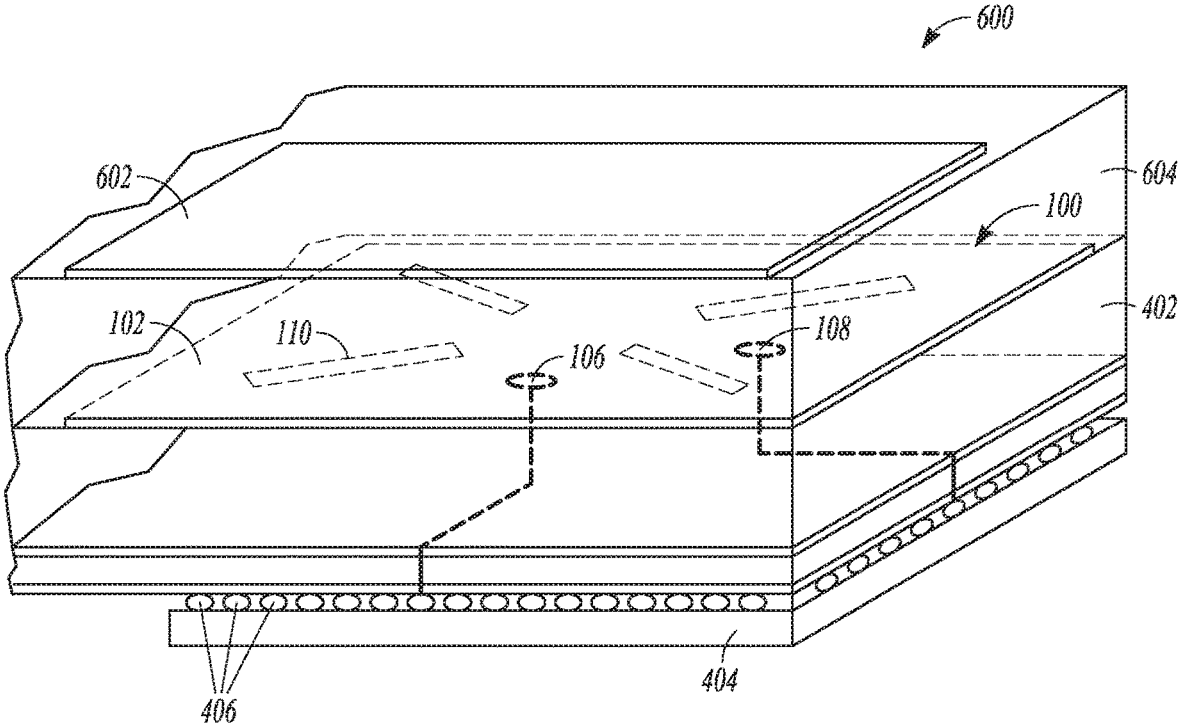
FIG. 6 is a perspective cross section view of an electronic package including a patch with a plurality of antenna apertures and a secondary patch, according to an embodiment.

The first antenna feed 106 and the second antenna feed 108 can be coupled to the patch 102 for communicating signals to and from the patch 102. In one example, the first antenna feed 106 and the second antenna feed 108 can be an extension of the conductive sheet 102 (e.g., edge-fed by a conductive trace). For instance, the first antenna feed 106 or second antenna feed 108 can be located on the same conductive layer of the substrate as the patch 102. As shown in the example of FIG. 1, the first antenna feed 106 and the second antenna feed 108 can be disposed perpendicular to the conductive sheet 102. For instance, the first antenna feed 106 and the second antenna feed 108 can be probe-fed or via-fed antenna feeds. The first antenna feed 106 and the second antenna feed 108 can be soldered, laminated, or otherwise electrically coupled to the conductive sheet 102. In one example, the first antenna feed 106 and the second antenna feed 108 can be electrically coupled between the conductive sheet 102 and a die or other transceiver (as shown in FIGS. 2 & 6 and described further herein).

The antenna feeds, such as the first antenna feed 106 and the second antenna feed 108, can be positioned on the patch 102 to transmit or receive a signal along at least one polarization direction of the patch 102. For instance, the first antenna feed 106 can be positioned to transmit or receive a first signal along the first polarization direction 112 and the second antenna feed 108 can be positioned to transmit or receive a second signal along a second polarization direction 114. In some examples, locations of the first antenna feed 106 and the second antenna feed 108 can be positioned on the patch 102 to reduce reflection of an electromagnetic signal. For instance, the location of the first antenna feed 106 and the second antenna feed 108 can be positioned where the impedance on the patch 102 is similar to the impedance along the respective antenna feed or an electronic circuit including the respective antenna feed. In one example, the first antenna feed 106 and the second antenna feed 108 can be at a location that is offset from the edge 104, for instance, at a distance where the impedance on the patch 102 is similar to the impedance along the respective feed line or the electrical circuit that includes the respective feed line. In one example, wherein the patch 102 is tuned to 30 GHz, the antenna feed 106 or the antenna feed 108 can be located at a distance of 0.67 mm from the edge 104. In the example of FIG. 1, the first antenna feed 106 can be located along a centerline of the patch 102 extended along the first polarization direction 112, and the second antenna feed 108 can be located along a center line of the patch 102 extended along the second polarization direction 114. Accordingly, the signals transmitted or received from the patch 102 can propagate symmetrically along the first polarization direction 112 and the second polarization direction 114. In other examples, the first antenna feed 106 or the second antenna feed 108 can be located on the edge 104 of the patch 102 or at one or more of the corners of the patch 102.

The antenna aperture 110 can be located on the patch 102 and can extend through the conductive sheet to form a void in the patch antenna 100. The aperture 110 can provide a discontinuity in the conductive sheet between the first antenna feed 106 and the second antenna feed 108. Accordingly, the signal isolation between the first antenna feed 106 and the second antenna feed 108 can be increased by one or more of the following mechanisms. In one example, locations through which the antenna signals can propagate are reduced. Accordingly, the antenna aperture 110 can reduce an area on the conductive sheet through which the signals can propagate. The reduced locations of signal propagation can increase the impedance between the first antenna feed 106 and the second antenna feed 108. For instance, the first signal from the first antenna feed 106 can propagate closer to an opposing second signal from the second antenna feed 108 because lower impedance paths have been removed by the location of the aperture 110. Because the first signal is propagating in an opposing direction to the second signal, impedance of the first and second signals will be increased through mutual coupling between the first and second signals. The closer a first signal path of the first signal is to a second signal path of the second signal, the greater the amount of mutual coupling will be generated between the two signals. The first signal can be mutually coupled to the second signal by capacitance or inductance. Where the signals oscillate at a high frequency, the mutual coupling generated by each signal will be high. Accordingly, the impedance is increased by placing the slot such that the first and second signal paths must propagate close to one another.

In one or more examples, the location of the aperture 110 can increase the length of the signal paths between the first antenna feed 106 and the second antenna feed 108. The increased length of the signal paths can increase the electrical resistance of the first and second signal paths between the first antenna feed 106 and the second antenna feed 108. Accordingly, the increased electrical resistance can improve the isolation between the first antenna feed 106 and the second antenna feed 108. In one example, the increased length of the signal path can result in dissipation of signal power due to radiation from the patch 102. Dissipation of the signal power can decrease interference between the first signal and the second signal.

As previously stated, the aperture 110 can be isolated from one or more edges 104 of the patch 102. In other words, the one or more apertures 110 can be located entirely on the patch 102, as shown in FIG. 1. For instance, the aperture 110 does not intersect the edge 104 to form an open slot at the edge 104 of the patch 102. Radiation efficiency of the patch antenna 100 can be increased as a result of the location of the aperture 110 being isolated from the edge 104 the patch 102. In one example, where the patch 102 is tuned to 30 GHz, the aperture 110 can be located at a distance of 1.53 mm from the corner of the patch 102. In other examples, the aperture 110 can be located at least 0.02 mm from any edge 104 of the patch 102. The isolation of the aperture 110 from the edge 104 can reduce a fringing electrical field along the edge 104 and can correspondingly reduce a transverse electromagnetic mode. Because transverse electromagnetic modes can reduce the radiation efficiency of the patch antenna 100, the isolation of the aperture 110 from the edge 104 can accordingly increase the radiation efficiency of the patch antenna 100.

As shown in the example of FIG. 1, the antenna aperture 110 can be located along an aperture path 116 bisecting the first polarization direction 112 and the second polarization direction 114 of the patch 102. The term bisecting, as referred to herein, means dividing an angle or an area into two similarly sized or shaped parts including, but not limited to, dividing an angle or an area into to equal parts or two symmetrical parts. In the example of a rectangular patch 102, the aperture path 116 can be located along a diagonal of the patch 102, such as a diagonal extended between the first antenna feed 106 and the second antenna feed 108. For instance, the aperture path 116 can be extended diagonally with respect to the first polarization direction 112 and the second polarization direction 114.

The antenna aperture 110 can be a shape including, but not limited to, a circle, oval, square, rectangle, triangle, polygon, or other shape. In one or more examples, the antenna aperture 110 can be elongate having a length greater than a width (i.e., the antenna aperture can be a slot). For instance, the antenna aperture 110 can include length of 0.05 mm to 14.0 mm and a width of 0.1 mm to 1.0 mm. In one example, where the patch antenna 100 is tuned to 28 GHz, the aperture 110 can include a width of 0.1 mm and a length of 0.7 mm. Where the antenna aperture 110 is elongate, the length of the elongate antenna aperture 110 can be disposed along the aperture path 116 as shown in FIG. 1. Depending on the size, shape, or location of the antenna apertures 110, a plurality of antenna apertures 110 can be located along the aperture path 116 to increase signal isolation between the first antenna feed 106 and the second antenna feed 108. In one example, the antenna apertures 110 can be located symmetrically about the first polarization direction 112, second polarization direction 114, or both. The symmetrical placement of the antenna apertures 110 can provide symmetrical radiation patters from the first antenna feed 106, the second antenna feed 108, or both.

In the example of FIG. 1, at least one antenna aperture can be located in each quadrant of the patch 102. For instance, the patch 102 can be divided into quadrants along the first polarization direction 112 and the second polarization direction 114. The antenna apertures 110 can be positioned symmetrically about the first polarization direction 112 or the second polarization direction 114. In other words, the antenna apertures 110 located on a first side of the first polarization direction 112 can be symmetrical with the antenna apertures 110 located on the second side of the first polarization direction 112. Likewise, the antenna apertures 110 located on a first side of the second polarization direction 114 can be symmetrical with antenna apertures 110 located on a second side of the second polarization direction 114. Accordingly, signals from the first antenna feed 106 and the second antenna feed 108 can radiate from the patch 102 symmetrically. In one or more examples, the length of the edge of each quadrant can extend the full length or width of the patch 102 respectively or substantially the full length or width of the patch 102.

The patch 102 can include various radiating directions having corresponding radiating dimensions. For instance, the patch 102 can have a first radiating dimension along the first polarization direction 112, where the first polarization direction 112 is aligned normal to the edge 104 of a rectangular patch 102. The patch 102 can include a second radiating dimension across a diagonal or at an angle with respect to the first polarization direction 112. Because the radiating dimension across the patch 102 can be a plurality of values depending upon the path of propagation across the patch 102, the patch 102 can be tuned to radiate the signal at more than one frequencies. For instance, the radiating dimension can be reduced across a smaller dimension of the patch 102 (e.g., across the center) or increased across a longer dimension (e.g., across a diagonal). By positioning the apertures 110 at a position on the patch 102 where a number of radiating directions (e.g., paths) that do not cross an aperture 110 can be increased, for instance, positioning the apertures 110 at an angle or along a diagonal of the patch, the number of radiating dimensions can be correspondingly increased. Accordingly, the bandwidth of the radiated signal can be increased because the radiating signal can propagate along a radiating dimension that is tuned to (i.e., resonates with) the radiating frequency.

In one example, the bandwidth of the patch antenna 100 can be increased as compared to a patch antenna without apertures 110. For instance, interference between the first signal and the second signal can be reduced by positioning the apertures 110 on the patch 102 as previously described. The reduction in interference can increase a quality factor of the patch 102. Increasing the quality factor of the antenna 102 can result in an increase of the bandwidth of the antenna 102. Accordingly, the bandwidth of the patch antenna 100 can be increased as compared to a patch antenna without apertures 110.

In some examples, the patch antenna 100 can operate as a phased-array antenna. For instance, the first signal can be transmitted at a different phase with respect to a phase of the second signal transmission. In other examples signals propagating from a first patch (e.g., patch 102) can be transmitted at a different phase than signals propagating from a second patch. In a further example, signals propagating from a first electronic package including the patch 102 can be transmitted at a different phase than signals propagating from at least one secondary electronic package including at least one patch. Directionality of the patch antenna 100 can be increased by operating the patch antenna 100 in a phased-array mode of operation. In one example, the signals transmitted from the phased-array antenna can be operated to include a steerable beam. For instance, the directionality of the phased-array can be adjustable between one or more polarization directions. Symmetry between a radiation pattern of the first signal and a radiation pattern of the second or subsequent signals can increase uniformity of a combined signal of the first and second signals. Accordingly, the symmetric radiation patterns of the first signal and second signal can increase the directionality or power of the phased-array operation.

FIG. 2 illustrates a cross section of an electronic package 200 configured for transmitting or receiving signals, such as wireless communications signals. The electronic package 200 can include a substrate 202, a die 204, and the patch antenna 100. The patch 102 of the patch antenna 100 can be located on the substrate 202. For instance, the patch 102 can be coupled to the substrate 202 in one or more ways. In one example, the substrate 202 can include a Copper Clad Laminate (CCL). The CCL can include the conductive sheet (e.g., metallic foil) that can be attached to (e.g., laminated on) one or more dielectric layers 208 of the substrate 202. In one example, the conductive sheet can be printed on to the substrate 202, for instance with an inkjet printer. In one example, the conductive sheet of the patch 102 can be electrodeposited (electroplated) onto the substrate 202. Once the conductive sheet is coupled to the substrate 202, the conductive sheet can then be etched to create the shape of the patch 102 and the one or more apertures 110.

The substrate 202 can include a single sided, double sided, or multi-layer construction. For instance, the substrate 202 can have dielectric layers 408 fabricated from materials including, but not limited to, FR-4, prepreg, ceramic, epoxy, other glass or fiber filled resin, or the like. The substrate 202 can provide mechanical support for the electronic package 200, a platform for the patch 102, circuit routing, ground plane support, thermal energy distribution, or electromagnetic shielding, among other things. For instance, the substrate 202 can include a core including, but not limited to, a ceramic core for providing mechanical support. In one example, the substrate 202 can include at least one ground plane 210. The ground plane 210 can be separated from the patch 102 be at least one dielectric layer 208. In some examples, fringing currents can be generated between the patch 102 and the ground plane 210. The fringing currents can, for instance, increase the wavelength of the radiated signal.

The die 204 can communicate signals to the patch antenna 100 through one or more antenna feeds, for example, the first antenna feed 106 or the second antenna feed 108. As previously described, the first antenna feed 106 and the second antenna feed 108 can be a via, through-hole via, a conductive trace, or any combination thereof located through or on the substrate 202. The die 204 can be coupled to the substrate 202. For instance, the location of the die 204 on the substrate 202 can be on the same side of the substrate 202 as the patch antenna 100 or on an opposing side of the substrate 202, as shown in FIG. 2.

The die 204 can include one or more contacts 206 coupling the die 204 to one or the conductive sheets of the substrate 202. The one or more contacts 206 can include, but are not limited to, at least one surface mount lead, a ball grid array, land grid array, or the like. In one example, the contacts 206 of the die 204 can be soldered to the conductive sheet. For instance, the die 204 can be placed (e.g., by a pick-and-place machine) on solder paste deposited over the conductive sheet. The die 204 can then be soldered to the conductive sheet by use of a reflow oven or infrared oven. The die 204 can include a circuit, such as an integrated circuit. In one example, the die 204 can be fabricated from a silicon wafer, gallium arsenide, gallium nitride, indium phosphate, or other semiconductor. The die 204 can include, but is not limited to, a processor, microprocessor, random access memory, radio transceiver, arithmetic unit, or the like. The die 204 can be in electrical communication with one or more conductive sheets through the contact 206.

Figure 3:
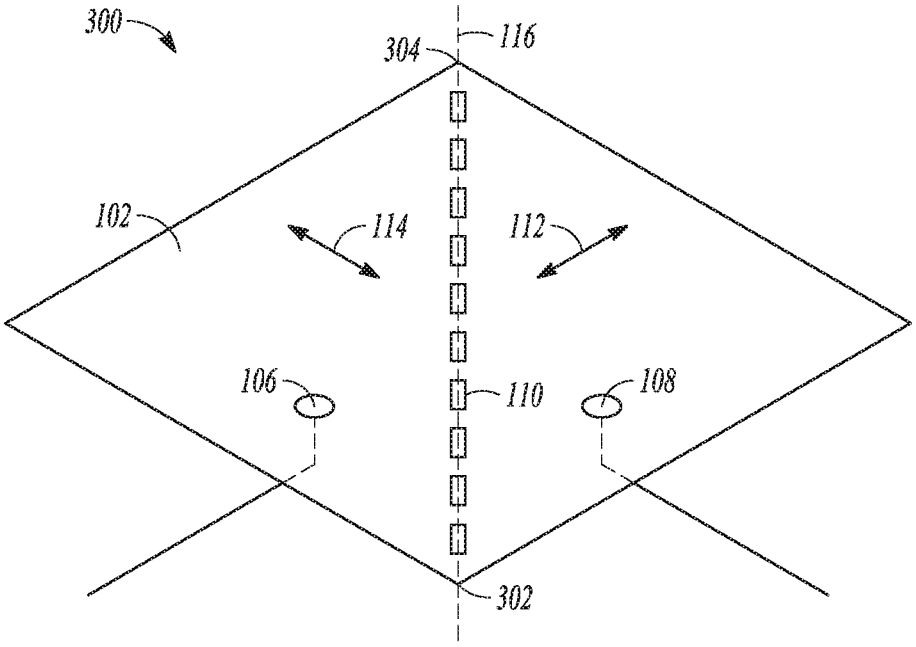
FIG. 3 is a perspective view of a patch antenna including a plurality of antenna apertures disposed along a diagonal aperture path from a first side of a patch to an opposing side of the patch, according to an embodiment.

FIG. 3 depicts an exemplary a patch antenna 300 including a plurality of apertures 110 disposed along a diagonal aperture path 116 from a first side of the patch 102 to an opposing side of the patch 102. For instance, the plurality of apertures 110 can be disposed between a first edge 104 and a second edge 104 or between a first corner and a second corner. As shown in the example of FIG. 3, four or more apertures 110 can be disposed along the aperture path 116. In one example, the plurality of apertures 110 can include a length and width as previously described herein. The apertures 110 can be spaced apart by 0.02, 0.05, 0.10, 0.2 mm, or other amount. The patch antenna 500 can include the first antenna feed 106 and the second antenna feed 108 as previously shown in FIG. 1 and described herein. The first antenna feed 106 and the second antenna feed can be located to radiate a signal along the first polarization direction 112 or a second polarization direction 114.

Figure 4:
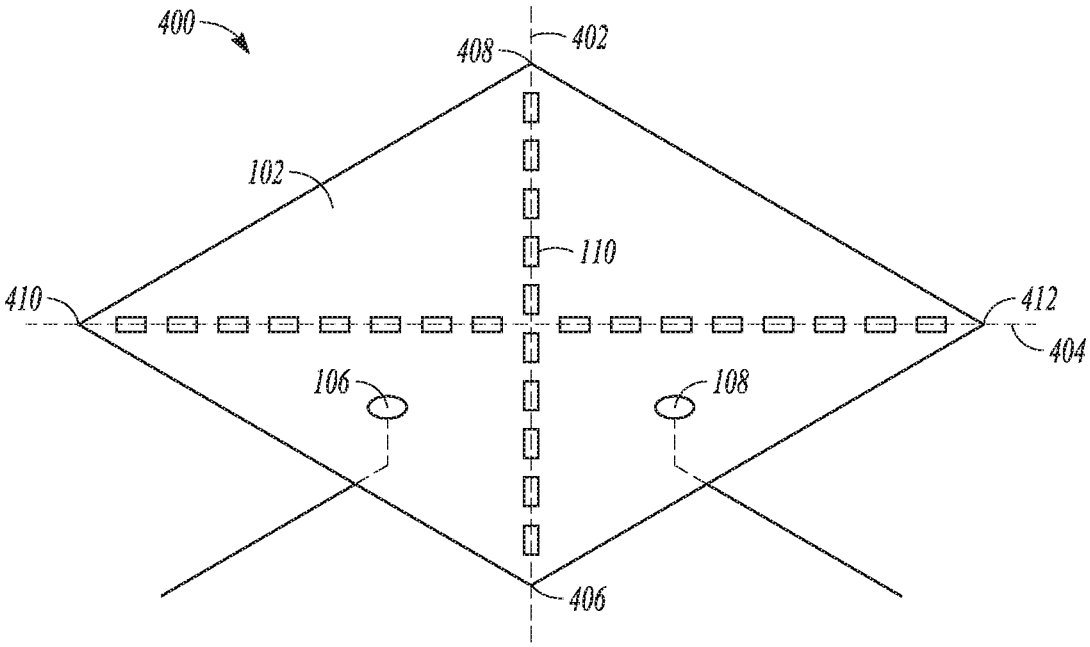
FIG. 4 is a perspective view of a patch antenna including a plurality of antenna apertures disposed along a first diagonal aperture path and a second diagonal aperture path, according to an embodiment.

FIG. 4 depicts an exemplary a patch antenna 100 including a plurality of apertures 110 disposed along the aperture path 116, such as a first aperture path 402 and a second aperture path 404. The apertures 110 can be disposed along the aperture path 402 from a first side of the patch 102 to an opposing second side of the patch 102, a first edge 104 to a second edge 104, or a first corner 406 to a second corner 408 as shown in the example of FIG. 4. In an example, the plurality of apertures 110 can be disposed along the aperture path 404 from a third side of the patch 102 to an opposing fourth side of the patch 102, a third edge 104 to a fourth edge 104, or a third corner 410 to a fourth corner 412 as shown in the example of FIG. 4. As shown in the example of FIG. 4, four or more apertures 110 can be disposed along the aperture path 402 or 404.

As shown in FIGS. 3 and 4, the patch 102 can include a rectangular shape. The aperture path 116 can extend along a diagonal of the rectangular shaped patch 102. The apertures 110 can decrease the area of the patch 102 through which signals can propagate between the first antenna feed 106 and the second antenna feed 108. Stated another way, the apertures 110 create a series of narrow conduction paths located between the first antenna feed 106 and the second antenna feed 108. Accordingly, the exemplary configuration of FIG. 3 provides isolation between the first antenna feed 106 and the second antenna feed 108 by increasing the impedance path between the first antenna feed 106 and the second antenna feed 108. For instance, the impedance can be increased through mutual coupling generated by opposing currents from the first antenna feed 106 and the second antenna feed 108 propagating within close proximity to one another across the narrow conduction paths between the apertures 110.

Figure 5:
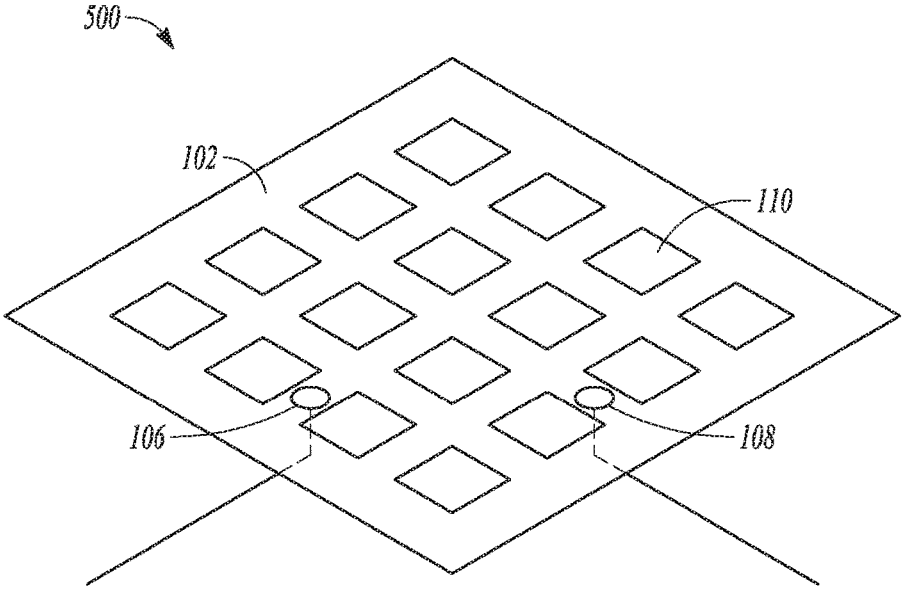
FIG. 5 is a perspective view of a patch antenna including a plurality of antenna apertures arranged in a meshed pattern, according to an embodiment.

FIG. 5 illustrates an exemplary patch antenna 500 including a patch 102 having a meshed pattern of apertures 100. The meshed pattern of apertures 110 can increase the impedance between the first antenna feed 106 and the second antenna feed 108 as previously described herein. As shown in the in the example of FIG. 5, the meshed pattern of apertures 110 can include a grid pattern of apertures 110 arranged along the first polarization direction 112 and the second polarization direction 114. The apertures 110 can be arranged in any pattern having a continuous conduction path along the first polarization direction 112 and the second polarization direction 114. In one or more examples, the apertures 110 can be any size and shape, for instance, the sizes and shapes previously described herein.

FIG. 6 depicts an exemplary cross section of an electronic package 600 including a secondary patch 602. The electronic package 600 can include the substrate 202, the die 204, the patch 102, and the secondary patch 602. The first antenna feed 106 and the second antenna feed 108 can be communicatively coupled the die 204 to through one or more contacts 206. The first antenna feed 106 or the second antenna feed 108 can be coupled to the patch 102, the secondary patch 602, or any combination thereof. In the example of FIG. 6, the first antenna feed 106 and the second antenna feed 108 can be coupled to the patch 102. In various examples, at least one antenna feed can be coupled to the patch 102, the secondary patch 602, or other secondary patches. For example, the electronic package 600 can include two or more secondary patches 602.

The substrate 202 can include an additional dielectric layer (e.g., secondary dielectric layer 604) between secondary patch 602 and the patch 102. The secondary patch 602 can be capacitively coupled to the patch 102. For instance, signals propagating along the patch 102 can generate additional signals on the secondary patch 602 though a capacitance between the patch 102 and the secondary patch 602. As shown in the example of FIG. 6, the first antenna feed 106 and the second antenna feed 108 can be vias located in the substrate 202 and electrically coupled between the patch 102 and the die 204. In other examples, the first antenna feed 106 or second antenna feed 108 can be located on the same conductive layer of the substrate as the patch 102 or the patch 702 to form an edge fed antenna feed.

The secondary patch 602 can be tuned to resonate at one or more frequencies. For instance, the secondary patch 602 can be tuned to resonate at one or more frequencies other than the resonant frequencies of the patch 102. Accordingly, the bandwidth that can be transmitted or received from the electronics package 600 can be increased beyond the possible bandwidth of the patch 102 as a result of the secondary patch 602 including one or more resonant frequencies different than those of the patch 102. The one or more signals from the antenna feeds, such as the first antenna feed 106 and the second antenna feed 108 can be transmitted from the patch 102 to the secondary patch 602 through capacitive coupling. In some examples, the electronic package can operate as a phased-array antenna. For instance, the first patch 102 can transmit one or more first signals of the phased-array. In a further example, the secondary patch 602 can transmit one or more signals of the phased-array independently or in combination with the one or more signals transmitted from the patch 102. In a further example, the electronic package 600 can be included in a larger phased-array antenna. For instance, the phased-array antenna can include the electronics packages 600 and other electronics packages having antennas adapted for phased-array operation.

In one or more examples, the patch 102, the patch 602, or both can include one or more apertures 110. The apertures 110 can be sized, shaped, and positioned on one or both of the patch 102 and secondary patch 602 as previously described herein. In the example of FIG. 6, the apertures 110 are located on the patch 102. In one example, wherein the secondary patch includes apertures 110, the apertures 110 on the secondary patch 602 can mirror the apertures on the patch 102. In other examples, the apertures 110 on the secondary patch 602 can be arranged, sized, or shaped differently than the apertures 110 located on the patch 102.

Figure 7:
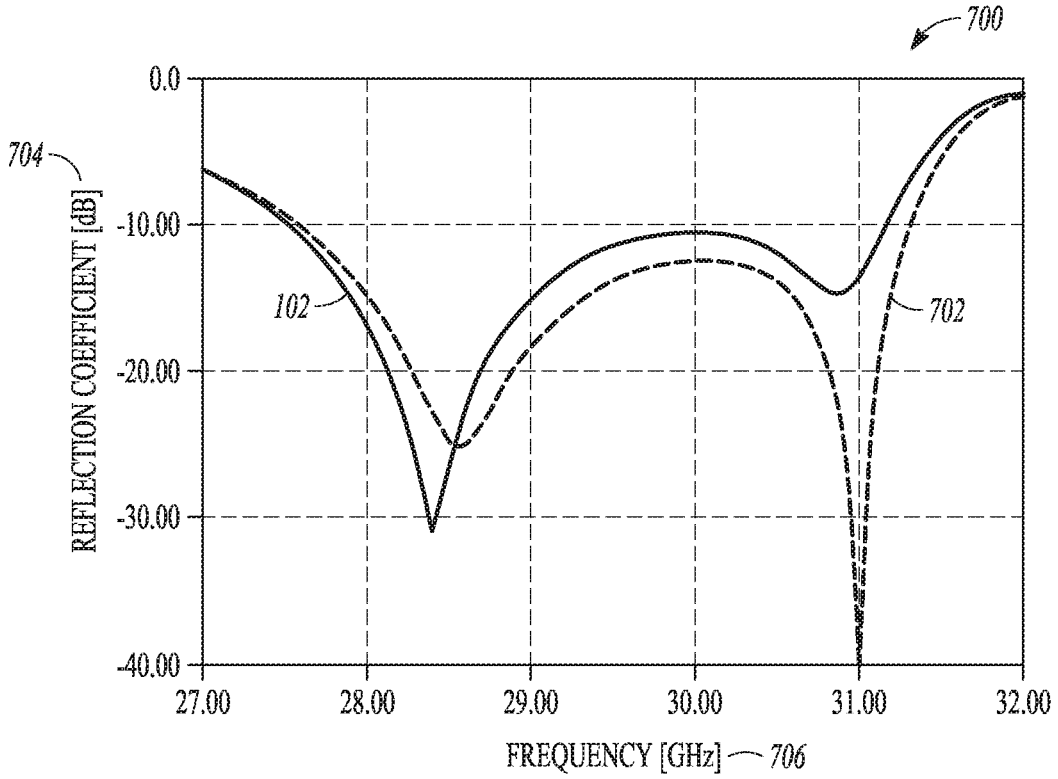
FIG. 7 is a graph of experimental results comparing a simulated reflection coefficient for a patch antenna without antenna apertures to a simulated reflection coefficient of a patch antenna including at least one antenna aperture, according to an embodiment.

FIG. 7 shows a reflection coefficient graph 700 comparing an example of a simulated reflection coefficient 704 for a control patch 702 without antenna apertures 110 to an example of a patch antenna 600 including a patch 102 having at least one antenna aperture 110 and a secondary patch 602. The secondary patch 602 can be capacitively coupled to the patch 102 as previously described. The simulation was conducted using 3D electromagnetic analysis software. The control patch 702 and the patch 102 include a similar shape, size, and material. The difference between the control patch 702 and the patch antenna 600 is the inclusion of antenna apertures 110 on the patch 102, as shown and arranged in the example of FIG. 6. The results of the reflection coefficient 704 are charted with respect to frequency 706 along the x-axis of the reflection coefficient graph 700. For instance, the frequency range of the results includes 27.0 GHz to 32.0 GHz in the example of FIG. 7. On the y-axis of the reflection coefficient graph 700, the reflection coefficient for the control patch 702 and the patch 102 is plotted between −40.0 dB to 0.0 dB. As shown in FIG. 7, the patch 102 including the antenna apertures 110 has a higher reflection coefficient 704 than the control patch 702 from about 27.6 GHz to 32.0 GHz. Where in the patch 102 or patch 602 includes the apertures 110, there can be about 0.5 dB more reflection than the control patch 702. Because the reflection coefficient 704 is lower than −10.0 dB, the electronic package 600 can have acceptable impedance match between the patch 102 and the feed lines 106, 108. Accordingly, the patch 102 or secondary patch 602 can radiate without having a high (greater than −10 dB) reflection coefficient 704.

Figure 8:
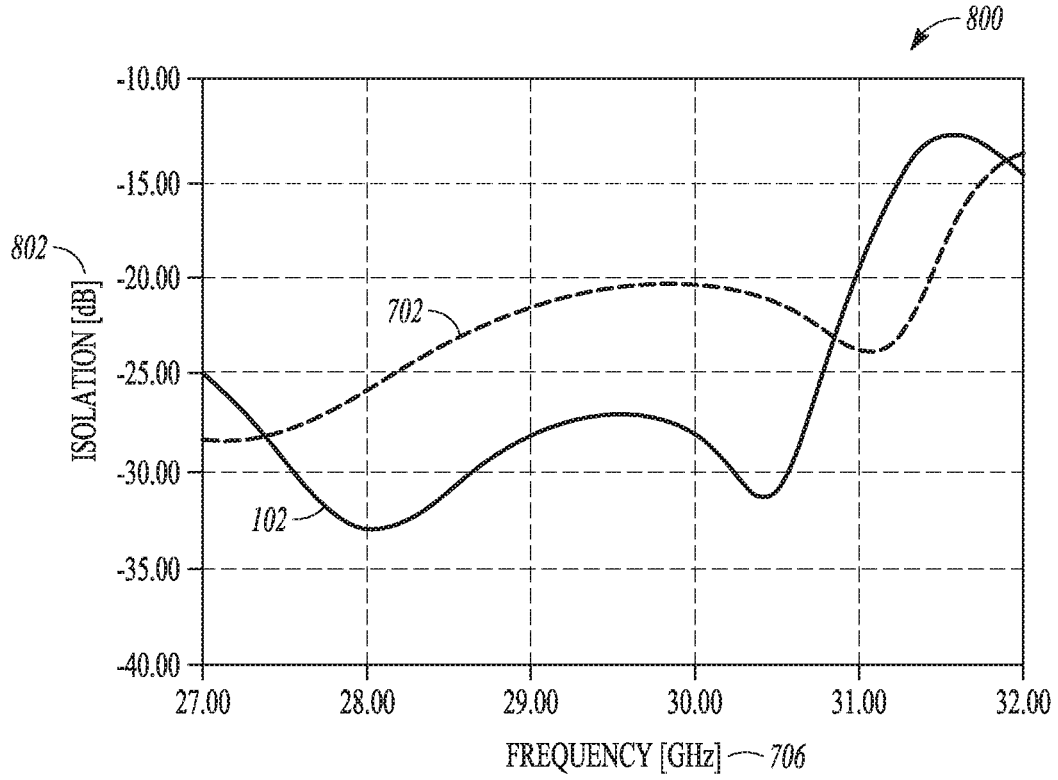
FIG. 8 is a graph of experimental results comparing simulated isolation between antenna feeds for a patch antenna without antenna apertures to a patch antenna including at least one antenna aperture, according to an embodiment.

FIG. 8 shows an isolation graph 800 comparing an example of simulated isolation 802 a control patch 702 without antenna apertures 110 to an example of a patch antenna 600 including a patch 102 having at least one antenna aperture 110 and a secondary patch 602. As previously discussed in the example of FIG. 7, the control patch 702 and the patch 102 include a similar shape, size, and material. The difference between the control patch 702 and the patch 102 is the inclusion of antenna apertures 110 as shown and arranged in the example of FIG. 6. The isolation 802 between the first antenna feed 106 and the second antenna feed 108 is plotted with respect to frequency 706 along the x-axis of the isolation graph 800. For instance, the frequency range of the results includes 27.0 GHz to 32.0 GHz as in the example of FIG. 7. On the y-axis of the isolation graph 800, the isolation between the first antenna feed 106 and the second antenna feed 108 is plotted between −40.0 dB to −10.0 dB. The isolation 802 of the patch 102 including the antenna apertures 110 of FIG. 6 is improved by about 10 dB between 28.0 GHz and 30.4 GHz. Accordingly, the antenna apertures 110 can increase signal gain transmitted or received from the first antenna feed 106 or the second antenna feed 108 of the patch 102. Stated another way, the signal strength and directionality transmitted or received from the patch 102 can be increased by including apertures 110 (e.g., as arranged in FIG. 6) on the patch 102. For instance, a radiation pattern of the patch antenna 100 can include reduced side lobes. In one example, the addition of the apertures 110 in the patch 102 can have little or no effect on the bandwidth that can be transmitted or received by the patch 102 as compared to the control patch 702.

Figure 9:
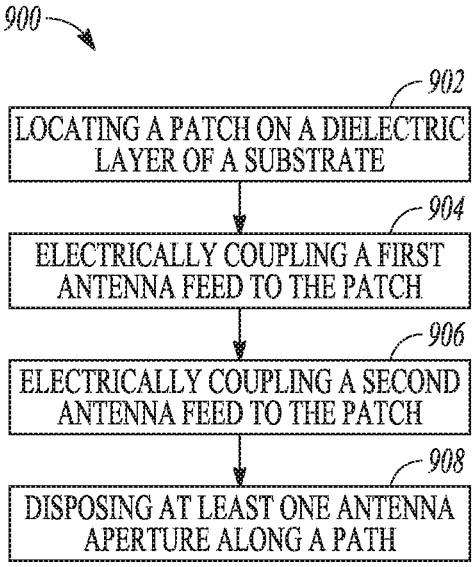
FIG. 9 is block diagram of an exemplary technique for making a patch antenna including at least one antenna aperture disposed along an aperture path bisecting a first polarization direction and a second polarization direction of a patch, according to an embodiment.

FIG. 9 shows a diagram of an exemplary technique 900 for making the patch antenna 100 previously described herein and shown for instance in FIGS. 1-6. In describing the technique 900, reference is made to one or more components, features, functions, and processes previously described herein. Where convenient, reference is made to the components, features, processes and the like with reference numerals. Reference numerals provided are exemplary and are nonexclusive. For instance, features, components, functions, processes, and the like described in the technique 900 include, but are not limited to, the corresponding numbered elements provided herein. Other corresponding features described herein (both numbered and unnumbered) as well as their equivalents are also considered.

At 902, a patch 102 can be located on the dielectric layer 208 of the substrate 202, wherein the patch 102 includes the conductive sheet having the first polarization direction 112 tuned to the first wavelength and the second polarization direction 114 tuned to the second wavelength as previously described herein. For instance, the patch 102 can be coupled to the substrate 202 in one or more ways. In one example, the substrate can include a Copper Clad Laminate (CCL). The CCL can include the conductive sheet (e.g., metallic foil) that can be attached to (e.g., laminated on) one or more dielectric layers 208 of the substrate 202. In one example, the conductive sheet can be printed on to the substrate 202, for instance with an inkjet printer. In one example, the conductive sheet of the patch 102 can be electrodeposited (electroplated) onto the substrate 202. Once the conductive sheet is coupled to the substrate 202, the conductive sheet can then be etched to create the shape of the patch 102 and the one or more apertures 110. In one example, the substrate can include one or more bumpless build-up layers (BBUL). The patch 102 can be built-up on to the substrate 202 by any number of processes including, but not limited to those previously described herein.

At 904, the first antenna feed 106 can be electrically coupled to the patch 102. The location of the first antenna feed 106 can be arranged to transmit or receive a first signal along the first polarization direction 112 as previously described herein. In one or more examples, the first antenna feed 106 can be electrically coupled to the patch 102 by one or more methods including, but not limited to, electroplating, laminating, soldering, or other electrically conductive fastening method.

At 906, the second antenna feed 108 can be electrically coupled to the patch 102. The second antenna feed 108 can be electrically coupled to the patch 102 by the same methods described with regard to the first antenna feed 106. The location of the second antenna feed 108 can be arranged to transmit or receive a second signal along the second polarization direction 114.

At 908, at least one antenna aperture 110 can be disposed along the aperture path 116. In one or more example, a plurality of apertures 110 can be disposed along the aperture path 116. The orientation of the aperture path 116 can bisect the first polarization direction 112 and the second polarization direction 114. For instance, in one example, the aperture path 116 can be oriented along the patch 102 along a diagonal of the patch 102, such as along a diagonal of a rectangular patch 102. The one or more apertures 110 can be positioned along the aperture path 116 at locations including, but not limited to, between the first antenna feed 106 and the second antenna feed 108, along a diagonal of the patch 102, between the first side of the patch 102 and the second side of the patch 102 (opposing the first side), between the first edge 104 of the patch 102 and the second edge 104 of the patch 102, or any combination thereof. In one example, disposing at least one antenna aperture 110 along the aperture path 116 includes disposing four elongate antenna apertures 110 along one or more aperture paths 116. Each elongate antenna aperture 110 can be located in a different quadrant of the patch 102, equally spaced from a center of the patch 102, and symmetrically positioned with respect to a corresponding elongate antenna aperture 110 located in an opposing quadrant. For instance, the opposing quadrants have a symmetric shape.

In one example, the exemplary technique 900 can include attaching a secondary patch (e.g., secondary patch 602) to the substrate 202, wherein the substrate 202 includes the dielectric layer 208 (e.g., a first dielectric layer) and a secondary dielectric layer 604, the secondary patch 602 can be attached to the secondary dielectric layer 604. The patch 102 can be located between the secondary dielectric layer 604 and the dielectric layer 208.

Figure 10:
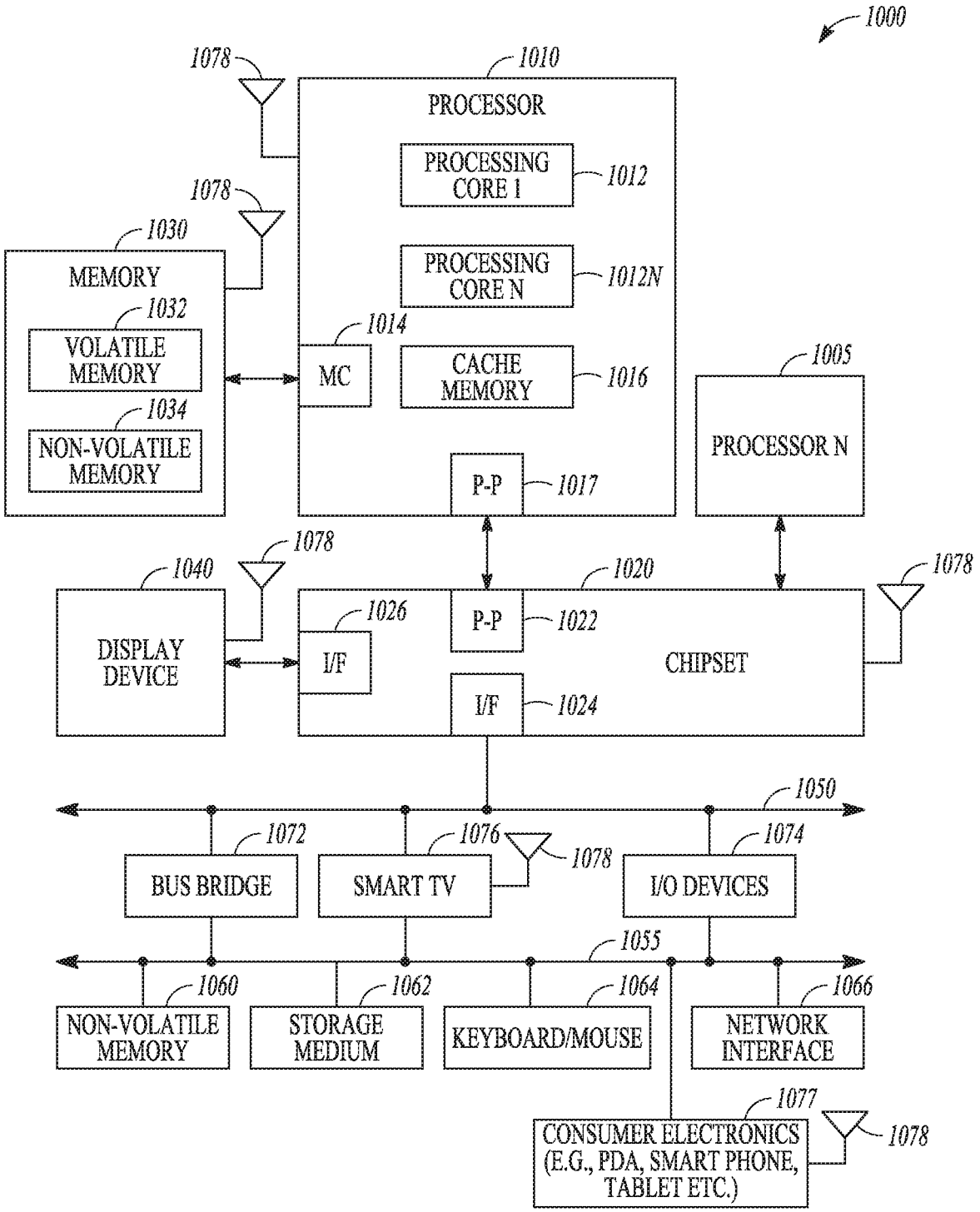
FIG. 10 is a block diagram of an electronic device incorporating at least one patch antenna having one or more apertures in accordance with at least one embodiment.

FIG. 10 illustrates a system level diagram, according to one embodiment of the invention. For instance, FIG. 10 depicts an example of an electronic device using patch antenna 100, 300, 400, or 500, or electronic package 200 or 600 as described in the present disclosure. FIG. 10 is included to show an example of a higher level device application for the present invention. In one embodiment, system 1000 (e.g., electronic device) includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 1000 is a system on a chip (SOC) system.

In one embodiment, processor 1010 has one or more processing cores 1012 and 1012N, where 1012N represents the Nth processor core inside processor 1010 where N is a positive integer. In one embodiment, system 1000 includes multiple processors including 1010 and 1005, where processor 1005 has logic similar or identical to the logic of processor 1010. In some embodiments, processing core 1012 includes, but is not limited to, pre-fetch logic to fetch instructions, decode logic to decode the instructions, execution logic to execute instructions and the like. In some embodiments, processor 1010 has a cache memory 1016 to cache instructions and/or data for system 1000. Cache memory 1016 may be organized into a hierarchal structure including one or more levels of cache memory.

In some embodiments, processor 1010 includes a memory controller 1014, which is operable to perform functions that enable the processor 1010 to access and communicate with memory 1030 that includes a volatile memory 1032 and/or a non-volatile memory 1034. In some embodiments, processor 1010 is coupled with memory 1030 and chipset 1020. Processor 1010 may also be coupled to a wireless antenna 1078 to communicate with any device configured to transmit and/or receive wireless signals. In one embodiment, the wireless antenna interface 1078 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 1032 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 1034 includes, but is not limited to, flash memory, phase change memory (PCM), read-only memory (ROM), electrically erasable programmable read-only memory (EEPROM), or any other type of non-volatile memory device.

Memory 1030 stores information and instructions to be executed by processor 1010. In one embodiment, memory 1030 may also store temporary variables or other intermediate information while processor 1010 is executing instructions. In the illustrated embodiment, chipset 1020 connects with processor 1010 via Point-to-Point (PtP or P-P) interfaces 1017 and 1022. Chipset 1020 enables processor 1010 to connect to other elements in system 1000. In some embodiments of the invention, interfaces 1017 and 1022 operate in accordance with a PtP communication protocol such as the Intel® QuickPath Interconnect (QPI) or the like. In other embodiments, a different interconnect may be used.

In some embodiments, chipset 1020 is operable to communicate with processor 1010, 1005N, display device 1040, and other devices 1072, 10710, 1074, 1060, 1062, 1064, 1066, 1077, etc. Chipset 1020 may also be coupled to a wireless antenna 1078 to communicate with any device configured to transmit and/or receive wireless signals.

Chipset 1020 connects to display device 1040 via interface 1026. Display 1040 may be, for example, a liquid crystal display (LCD), a plasma display, cathode ray tube (CRT) display, or any other form of visual display device. In some embodiments of the invention, processor 1010 and chipset 1020 are merged into a single SOC. In addition, chipset 1020 connects to one or more buses 1050 and 1055 that interconnect various elements 1074, 1060, 1062, 1064, and 1066. Buses 1050 and 1055 may be interconnected together via a bus bridge 1072. In one embodiment, chipset 1020 couples with a non-volatile memory 1060, a mass storage device(s) 1062, a keyboard/mouse 1064, and a network interface 1066 via interface 1024 and/or 1004, smart TV 1076, consumer electronics 1077, etc.

In one embodiment, mass storage device 1062 includes, but is not limited to, a solid state drive, a hard disk drive, a universal serial bus flash memory drive, or any other form of computer data storage medium. In one embodiment, network interface 1066 is implemented by any type of well known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra Wide Band (UWB), Bluetooth, WiMax, or any form of wireless communication protocol.

While the modules shown in FIG. 10 are depicted as separate blocks within the system 1000, the functions performed by some of these blocks may be integrated within a single semiconductor circuit or may be implemented using two or more separate integrated circuits. For example, although cache memory 1016 is depicted as a separate block within processor 1010, cache memory 1016 (or selected aspects of 1016) can be incorporated into processor core 1012.

Various Notes & Examples

Each of these non-limiting examples may stand on its own, or may be combined in various permutations or combinations with one or more of the other examples. To better illustrate the method and apparatuses disclosed herein, a non-limiting list of embodiments is provided here:

Example 1 is a patch antenna including a patch having a conductive sheet including at least one edge. The patch can include a first polarization direction and a second polarization direction. A first antenna feed can be coupled to the patch, wherein the first antenna feed is positioned to transmit or receive a first signal along the first polarization direction of the patch; a second antenna feed coupled to the patch. The second antenna feed can be positioned to transmit or receive a second signal along the second polarization direction of the patch. At least one antenna aperture can be isolated from an edge of the patch and disposed along an aperture path. An orientation of the aperture path can bisect the first polarization direction and the second polarization direction. The antenna aperture can be located between the first antenna feed and the second antenna feed.

In Example 2, the subject matter of Example 1 optionally includes wherein the antenna aperture is elongate, including a length and a width, and the length of the elongate antenna aperture can be disposed along the aperture path.

In Example 3, the subject matter of any one or more of Examples 1-2 optionally include wherein a plurality of antenna apertures can be disposed along the aperture path bisecting the first polarization direction and the second polarization direction.

In Example 4, the subject matter of any one or more of Examples 1-3 optionally include wherein a plurality of antenna apertures can be disposed along the aperture path from a first side of the patch to an opposing side of the patch.

In Example 5, the subject matter of any one or more of Examples 1-4 optionally include wherein the patch can include a secondary aperture path intersecting with the aperture path in the center of the patch, and a plurality of antenna apertures are located along the each of the aperture path and the secondary aperture path.

In Example 6, the subject matter of any one or more of Examples 1-5 optionally include wherein the patch can include four elongate antenna apertures, each elongate antenna aperture located in a different quadrant of the patch, equally spaced from a center of the patch and symmetrically positioned with respect to the first polarization direction and the second polarization direction.

In Example 7, the subject matter of any one or more of Examples 1-6 optionally include wherein the patch can be rectangular having a length along the first polarization direction and a width along the second polarization direction.

In Example 8, the subject matter of Example 7 optionally includes wherein the antenna apertures can be disposed along a diagonal of the patch and located between the first and second feed points.

In Example 9, the subject matter of any one or more of Examples 1-8 optionally include wherein the patch can include more than two polarization directions.

In Example 10, the subject matter of any one or more of Examples 1-9 optionally include wherein the patch can include a plurality of antenna apertures arranged in a meshed pattern.

Example 11 is an electronic package including a die adapted to generate a first signal and a second signal for transmission. The electronic package can include a substrate including at least one dielectric layer. The electronic packages can include a patch antenna having a patch having an electrically conductive sheet with at least one edge. The patch can include a first polarization direction and a second polarization direction. A first antenna feed can be communicatively coupled between the patch and the die. The first antenna feed can be positioned to transmit the first signal along the first polarization direction of the patch. A second antenna feed can be communicatively coupled between the patch and the die. The second antenna feed can be positioned to transmit the second signal along the second polarization direction of the patch. At least one antenna aperture can be isolated from an edge of the patch and disposed along an aperture path. An orientation of the aperture path can bisect the first polarization direction and the second polarization direction. The antenna aperture can be located between the first antenna feed and the second antenna feed.

In Example 12, the subject matter of Example 11 optionally includes wherein the antenna aperture can be elongate including a length and a width, and the length of the elongate antenna aperture is disposed along the aperture path.

In Example 13, the subject matter of any one or more of Examples 11-12 optionally include wherein a plurality of antenna apertures can be disposed along the aperture path from a first side of the patch to an opposing side of the patch.

In Example 14, the subject matter of any one or more of Examples 11-13 optionally include wherein the patch can include four elongate antenna apertures, each elongate antenna aperture can be located in a different quadrant of the patch, equally spaced from a center of the patch, and symmetrically positioned with respect to a corresponding elongate antenna aperture located in an opposing quadrant, wherein the opposing quadrants have a symmetric shape.

In Example 15, the subject matter of any one or more of Examples 11-14 optionally include wherein the patch can be rectangular, including a length along the first polarization direction and a width along the second polarization direction.

In Example 16, the subject matter of any one or more of Examples 11-15 optionally include wherein the patch can be rectangular, including a length along the first polarization direction and a width along the second polarization direction, and the antenna aperture is disposed along a diagonal of the patch and located between the first and second feed points.

In Example 17, the subject matter of any one or more of Examples 11-16 optionally include one or more secondary patches attached to the substrate, wherein the substrate can include a first dielectric layer and one or more secondary dielectric layers, the secondary patch can be attached to the one or more secondary dielectric layers, and the patch can be located between the one or more secondary dielectric layers and the first dielectric layer.

In Example 18, the subject matter of any one or more of Examples 11-17 optionally include one or more secondary patches attached to the substrate, and wherein the one or more secondary patches can include at least one secondary aperture, wherein the secondary aperture can be isolated from an edge of the patch.

In Example 19, the subject matter of any one or more of Examples 11-18 optionally include wherein the electronic package can be included in a phased-array antenna.

In Example 20, the subject matter of any one or more of Examples 11-19 optionally include wherein the patch can include a plurality of antenna apertures arranged in a meshed pattern.

Example 21 is a method including locating a patch on a dielectric layer of a substrate. The patch can include a conductive sheet having a first polarization direction tuned to a first wavelength and a second polarization direction tuned to a second wavelength. A first antenna feed can be electrically coupled to the patch. The location of the first antenna feed can be arranged to transmit or receive a first signal along the first polarization direction. A second antenna feed can be electrically coupled to the patch. The location of the second antenna feed can be arranged to transmit or receive a second signal along the second polarization direction. At least one antenna aperture can be disposed along a aperture path, an orientation of the aperture path bisecting the first polarization direction and the second polarization direction. The antenna aperture can be located between the first antenna feed and the second antenna feed.

In Example 22, the subject matter of Example 21 optionally includes wherein disposing at least one antenna aperture along the aperture path includes disposing an elongate antenna aperture including a length and a width, the length of the elongate antenna aperture disposed along the aperture path.

In Example 23, the subject matter of any one or more of Examples 21-22 optionally include wherein disposing at least one antenna aperture along the aperture path includes disposing a plurality of antenna apertures along the aperture path bisecting the first polarization direction and the second polarization direction.

In Example 24, the subject matter of any one or more of Examples 21-23 optionally include wherein disposing at least one antenna aperture along the aperture path can include disposing a plurality of antenna apertures disposed along the aperture path from a first side of the patch to an opposing side of the patch.

In Example 25, the subject matter of any one or more of Examples 21-24 optionally include wherein disposing at least one antenna aperture along the aperture path can include disposing four elongate antenna apertures, each elongate antenna aperture can be located in a different quadrant of the patch, equally spaced from a center of the patch, and symmetrically positioned with respect to a corresponding elongate antenna aperture located in an opposing quadrant, wherein the opposing quadrants have a symmetric shape.

In Example 26, the subject matter of any one or more of Examples 21-25 optionally include wherein disposing at least one antenna aperture along the aperture path can include disposing a plurality of antenna apertures along the aperture path and a secondary aperture path, wherein the secondary aperture path intersects with the aperture path in the center of the patch.

In Example 27, the subject matter of any one or more of Examples 21-26 optionally include wherein attaching a patch to a dielectric layer of a substrate can include attaching a rectangular patch having a length along the first polarization direction and a width along the second polarization direction.

In Example 28, the subject matter of any one or more of Examples 21-27 optionally include disposing at least one antenna aperture along the aperture path, the path can be located along a diagonal of the patch and located between the first and second feed points.

In Example 29, the subject matter of any one or more of Examples 21-28 optionally include attaching a patch to a dielectric layer of a substrate includes attaching a patch including more than two polarization directions.

In Example 30, the subject matter of any one or more of Examples 21-29 optionally include attaching a patch to a dielectric layer of a substrate includes attaching a patch including a plurality of antenna apertures arranged in a meshed pattern.

In Example 31, the subject matter of any one or more of Examples 21-30 optionally include wherein attaching a patch to a dielectric layer of a substrate can include attaching a rectangular patch, and disposing at least one antenna aperture along the aperture path includes disposing a plurality of antenna apertures along a diagonal of the patch.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A patch antenna comprising:

a patch including a conductive sheet having at least two edges, wherein the patch includes a first polarization direction and a second polarization direction;

a first antenna feed coupled to the patch, wherein the first antenna feed is positioned to transmit or receive a first signal along the first polarization direction of the patch;

a second antenna feed coupled to the patch, wherein the second antenna feed is positioned to transmit or receive a second signal along the second polarization direction of the patch;

at least four first antenna apertures isolated from a first edge of the at least two edges of the patch and disposed along a first aperture path, an orientation of the first aperture path bisects the first polarization direction and the second polarization direction, wherein an antenna aperture of the antenna apertures is located between the first antenna feed and the second antenna feed; and at least four second antenna apertures isolated from a second, perpendicular edge of the at least two edges of the patch and disposed along a second aperture path perpendicular to the first aperture path.

2. The patch antenna of claim 1, wherein the at least four first and second antenna apertures are elongate, including a length and a width, and the length of the elongate antenna aperture is disposed along the first and second aperture paths, respectively.

3. The patch antenna of claim 1, wherein a plurality of the first and second antenna apertures are disposed along the first and second aperture paths bisecting the first polarization direction and the second polarization direction.

4. The patch antenna of claim 1, wherein a plurality of the first and second antenna apertures are disposed along the first and second aperture paths from a first side of the patch to an opposing side of the patch.

5. The patch antenna of claim 1, wherein the patch includes a respective elongate antenna aperture located in a different quadrant of the patch, equally spaced from a center of the patch, and symmetrically positioned with respect to the first polarization direction and the second polarization direction.

6. The patch antenna of claim 1, wherein the patch is rectangular, including a length along the first polarization direction and a width along the second polarization direction.

7. The patch antenna of claim 6, wherein the at least four first and second antenna apertures are disposed along a diagonal of the patch and located between the first and second feed points.

8. The patch antenna of claim 1, wherein the patch includes more than two polarization directions.

9. The patch antenna of claim 1, wherein the patch includes a plurality of antenna apertures arranged in a meshed pattern.

10. An electronic package comprising;

a die adapted to generate a first signal and a second signal for transmission;

a substrate including at least one dielectric layer;

a patch antenna having a patch including an electrically conductive sheet with at least two edges, wherein the patch includes a first polarization direction and a second polarization direction;

a first antenna feed communicatively coupled between the patch and the die, wherein the first antenna feed is positioned to transmit the first signal along the first polarization direction of the patch;

a second antenna feed communicatively coupled between the patch and the die, wherein the second antenna feed is positioned to transmit the second signal along the second polarization direction of the patch;

at least four first antenna apertures isolated from a first edge of the at least two edges of the patch and disposed along a first aperture path, an orientation of the first aperture path bisects the first polarization direction and the second polarization direction, wherein an antenna aperture of the antenna apertures is located between the first antenna feed and the second antenna feed; and at least four second antenna apertures isolated from second, perpendicular edge of the at least two edges of the patch and disposed along a second aperture path perpendicular to the first aperture path.

11. The electronic package of claim 10, wherein the first and second antenna apertures are elongate, including a length and a width, and the length of the elongate antenna apertures are disposed along the first and second aperture paths, respectively.

12. The electronic package of claim 10, wherein a plurality of the first and second antenna apertures are disposed along the first and second aperture paths from a first side of the patch to an opposing side of the patch.

13. The electronic package of claim 10, wherein the patch includes a respective elongate antenna aperture located in a different quadrant of the patch, equally spaced from a center of the patch, and symmetrically positioned with respect to a corresponding elongate antenna aperture located in an opposing quadrant, wherein the opposing quadrants have a symmetric shape.

14. The electronic package of claim 10, wherein the patch is rectangular, including a length along the first polarization direction and a width along the second polarization direction.

15. The electronic package of claim 14, wherein the first and second antenna apertures are disposed along a diagonal of the patch and located between the first and second feed points.

16. The electronic package of claim 10, wherein the patch includes a plurality of antenna apertures arranged in a meshed pattern.

17. The electronic package of claim 10, further comprising one or more secondary patches attached to the substrate, wherein the substrate includes a first dielectric layer and one or more secondary dielectric layers, the secondary patch attached to the one or more secondary dielectric layers, and the patch located between the one or more secondary dielectric layers and the first dielectric layer.

18. The electronic package of claim 17, wherein, the one or more secondary patches include at least one secondary aperture, wherein the secondary aperture is isolated from an edge of the patch.

19. The electronic package of claim 10, wherein the electronic package is included in a phased-array antenna.

20. A method comprising:

locating a patch on a dielectric layer of a substrate, wherein the patch includes a conductive sheet having a first polarization direction tuned to a first wavelength and a second polarization direction tuned to a second wavelength;

electrically coupling a first antenna feed to the patch, wherein the location of the first antenna feed is arranged to transmit or receive a first signal along the first polarization direction;

electrically coupling a second antenna feed to the patch, wherein the location of the second antenna feed is arranged to transmit or receive a second signal along the second polarization direction;

disposing at least four first antenna apertures along a first aperture path, an orientation of the first aperture path bisecting the first polarization direction and the second polarization direction, wherein an antenna aperture of the first antenna apertures is located between the first antenna feed and the second antenna feed; and disposing at least four second antenna apertures along a second aperture path, an orientation of the second aperture path perpendicular to the first aperture path.

21. The method of claim 20, wherein disposing at least four first antenna apertures along the first aperture path includes disposing an elongate antenna aperture including a length and a width, the length of the elongate antenna aperture disposed along the first aperture path.

22. The method of claim 20, wherein disposing at least four antenna apertures along the first aperture path and along the second aperture path includes disposing four elongate antenna apertures, each elongate antenna aperture located in a different quadrant of the patch, equally spaced from a center of the patch, and symmetrically positioned with respect to a corresponding elongate antenna aperture located in an opposing quadrant, wherein the opposing quadrants have a symmetric shape.

23. The method of claim 20, wherein attaching a patch to a dielectric layer of a substrate includes attaching a rectangular patch and disposing at least four first antenna apertures along the first aperture path includes disposing a plurality of antenna apertures along a diagonal of the patch.

24. The method of claim 20, further comprising attaching a secondary patch to the substrate, wherein the substrate includes a first dielectric layer and a secondary dielectric layer, the secondary patch is attached to the secondary layer, and the patch is located between the secondary dielectric layer and the first dielectric layer.

* * * * *